US006802435B1

(12) United States Patent
Brawner, Jr.

(10) Patent No.: US 6,802,435 B1
(45) Date of Patent: Oct. 12, 2004

(54) WATER BACKPACK AND GUN ASSEMBLY

(76) Inventor: Gerald A. Brawner, Jr., 4301 S. Capitol St. SW., Washington, DC (US) 20032

( * ) Notice: Subject to any disclaimer, the term of this patent is extended or adjusted under 35 U.S.C. 154(b) by 17 days.

(21) Appl. No.: 10/405,285

(22) Filed: Apr. 3, 2003

(51) Int. Cl.[7] ..... A63H 3/18

(52) U.S. Cl. ..... 222/79; 222/175; 222/385; 273/349; 446/473; 446/475

(58) Field of Search ..... 222/79, 175, 78, 222/325, 383.1, 385, 529, 530, 63, 333, 386.5; 273/348–350, 371; 446/473, 28

(56) References Cited

U.S. PATENT DOCUMENTS 1,913,006 A * 6/1933 Smith ..... 224/148.2
2,684,787 A * 7/1954 Charpiat ..... 222/175
3,403,818 A * 10/1968 Bruno ..... 222/23
4,434,939 A * 3/1984 Stankowitz ..... 239/345
4,621,770 A * 11/1986 Sayen ..... 239/304
4,801,088 A * 1/1989 Baker ..... 239/152
4,902,262 A * 2/1990 Lunsford ..... 446/268
4,903,864 A * 2/1990 Sirhan ..... 222/78
5,188,610 A * 2/1993 Rains ..... 604/183
5,248,089 A * 9/1993 Bekius ..... 239/154
5,360,142 A * 11/1994 Stern et al. ..... 222/79
5,366,108 A * 11/1994 Darling ..... 222/1
5,538,457 A 7/1996 Deal
5,566,858 A * 10/1996 Ducker, III ..... 222/3
5,586,688 A * 12/1996 Johnson et al. ..... 222/61
5,595,325 A * 1/1997 Leres ..... 222/135
5,603,361 A * 2/1997 Cuisinier ..... 141/26
5,626,343 A 5/1997 Sanders
5,742,939 A 4/1998 Williams
5,855,371 A 1/1999 Sanders
5,921,445 A * 7/1999 Schmitz et al. ..... 222/385
6,041,436 A 3/2000 Keen
6,055,975 A * 5/2000 Gallagher et al. ..... 124/50
D426,273 S 6/2000 D'Andrade et al.

* cited by examiner

*Primary Examiner*—David A. Scherbel
*Assistant Examiner*—Frederick C. Nicolas

(57) ABSTRACT

A water backpack and gun assembly for allowing users to shoot water for entertainment and activity-related purposes. The water backpack and gun assembly includes a tank being adapted to be carried upon a user's back and being adapted to carry water therein and having a main portion and end portions, and also having a cap member being removably disposed upon an opening in a top wall of the tank through which water is put into the tank; and also includes a strap assembly being attached to the tank for allowing a user to carry the tank upon one's back; and further includes an assembly of shooting water from the tank including a pump being disposed in the tank for urging water from the tank, and also including a battery being connected to the pump, and further including a switch being connected to the battery and to the pump for the energizing of the pump, and also including water guns being connected with hoses to the water tank, and further including triggers for discharging water through the water guns.

8 Claims, 4 Drawing Sheets

WATER BACKPACK AND GUN ASSEMBLY

BACKGROUND OF THE INVENTION

1. Field of the Invention

The present invention relates to water guns and more particularly pertains to a new water backpack and gun assembly for allowing users to shoot water for entertainment and activity-related purposes.

2. Description of the Prior Art

The use of water guns is known in the prior art. More specifically, water guns heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 6,041,436; 5,855,371; 5,626,343; 5,742,939; 5,538,457; and Des. 426,273.

While these devices fulfill their respective, particular objectives and requirements, the aforementioned patents do not disclose a new water backpack and gun assembly. The prior art includes tanks and hoses and water guns connected to the hoses.

SUMMARY OF THE INVENTION

The general purpose of the present invention, which will be described subsequently in greater detail, is to provide a new water backpack and gun assembly which has many of the advantages of the water guns mentioned heretofore and many novel features that result in a new water backpack and gun assembly which is not anticipated, rendered obvious, suggested, or even implied by any of the prior art water guns, either alone or in any combination thereof. The present invention includes a tank being adapted to be carried upon a user's back and being adapted to carry water therein and having a main portion and end portions, and also having a cap member being removably disposed upon an opening in a top wall of the tank through which water is put into the tank; and also includes a strap assembly being attached to the tank for allowing a user to carry the tank upon one's back; and further includes an assembly of shooting water from the tank including a pump being disposed in the tank for urging water from the tank, and also including a battery being connected to the pump, and further including a switch being connected to the battery and to the pump for the energizing of the pump, and also including water guns being connected with hoses to the water tank, and further including triggers for discharging water through the water guns. None of the prior art includes the combination of elements of the present invention.

There has thus been outlined, rather broadly, the more important features of the water backpack and gun assembly in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new water backpack and gun assembly which has many of the advantages of the water guns mentioned heretofore and many novel features that result in a new water backpack and gun assembly which is not anticipated, rendered obvious, suggested, or even implied by any of the prior art water guns, either alone or in any combination thereof.

Still another object of the present invention is to provide a new water backpack and gun assembly for allowing users to shoot water for entertainment and activity-related purposes.

Still yet another object of the present invention is to provide a new water backpack and gun assembly that is easy and convenient to set up and use.

Even still another object of the present invention is to provide a new water backpack and gun assembly that is a toy that would be enjoyed by children and would provide an outdoor activity for the children.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
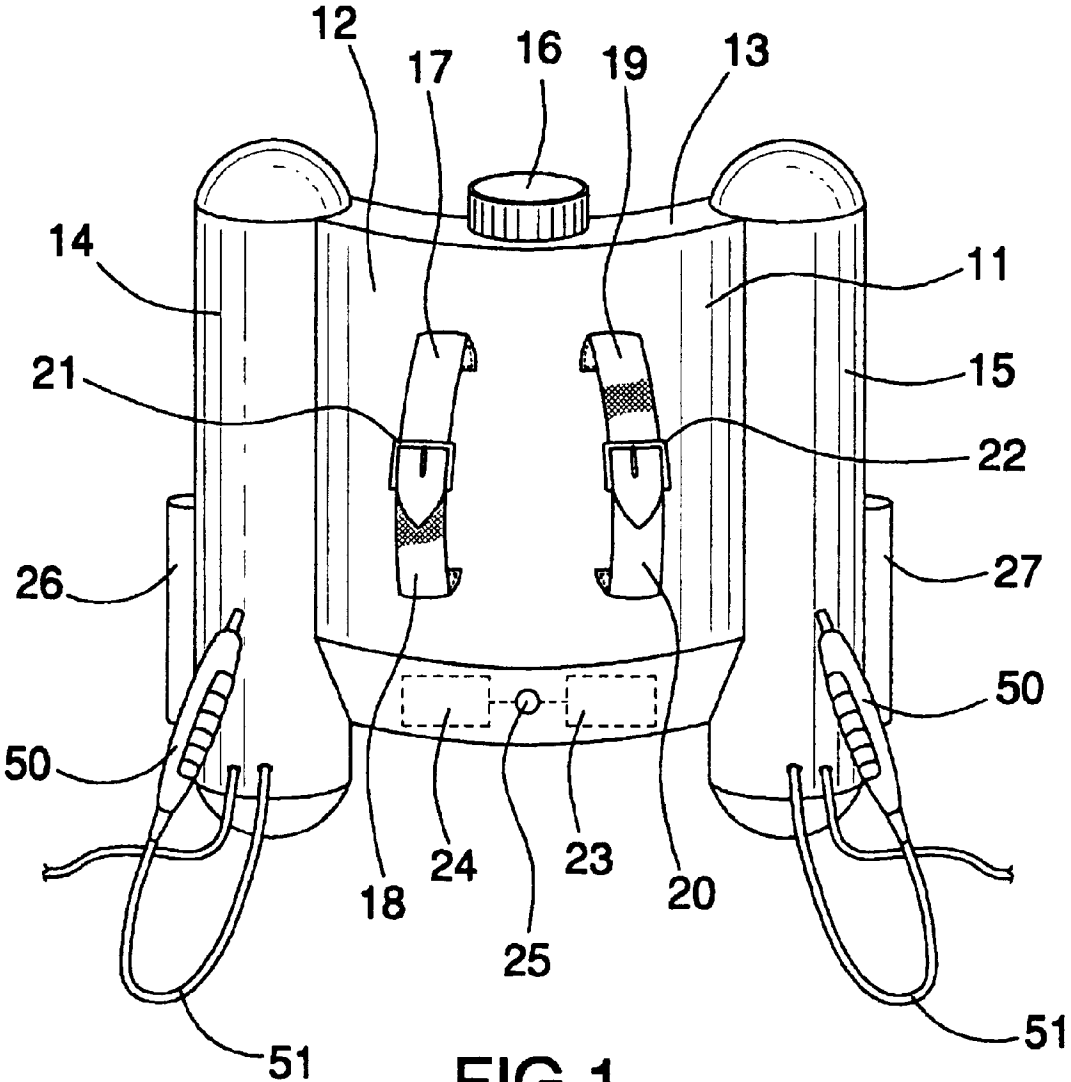
FIG. 1 is a perspective view of a new water backpack and gun assembly according to the present invention.
Figure 2:
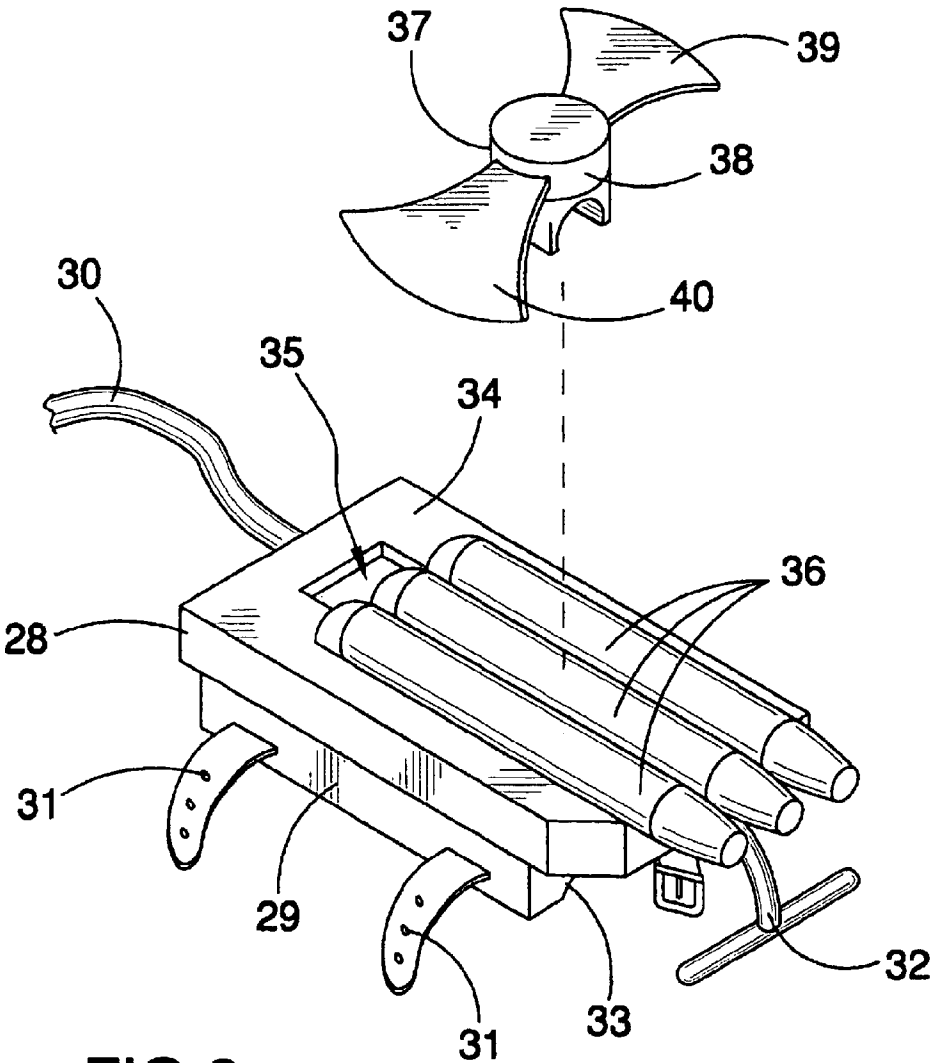
FIG. 2 is a detailed partial exploded view of a first water gun of the present invention.
Figure 3:
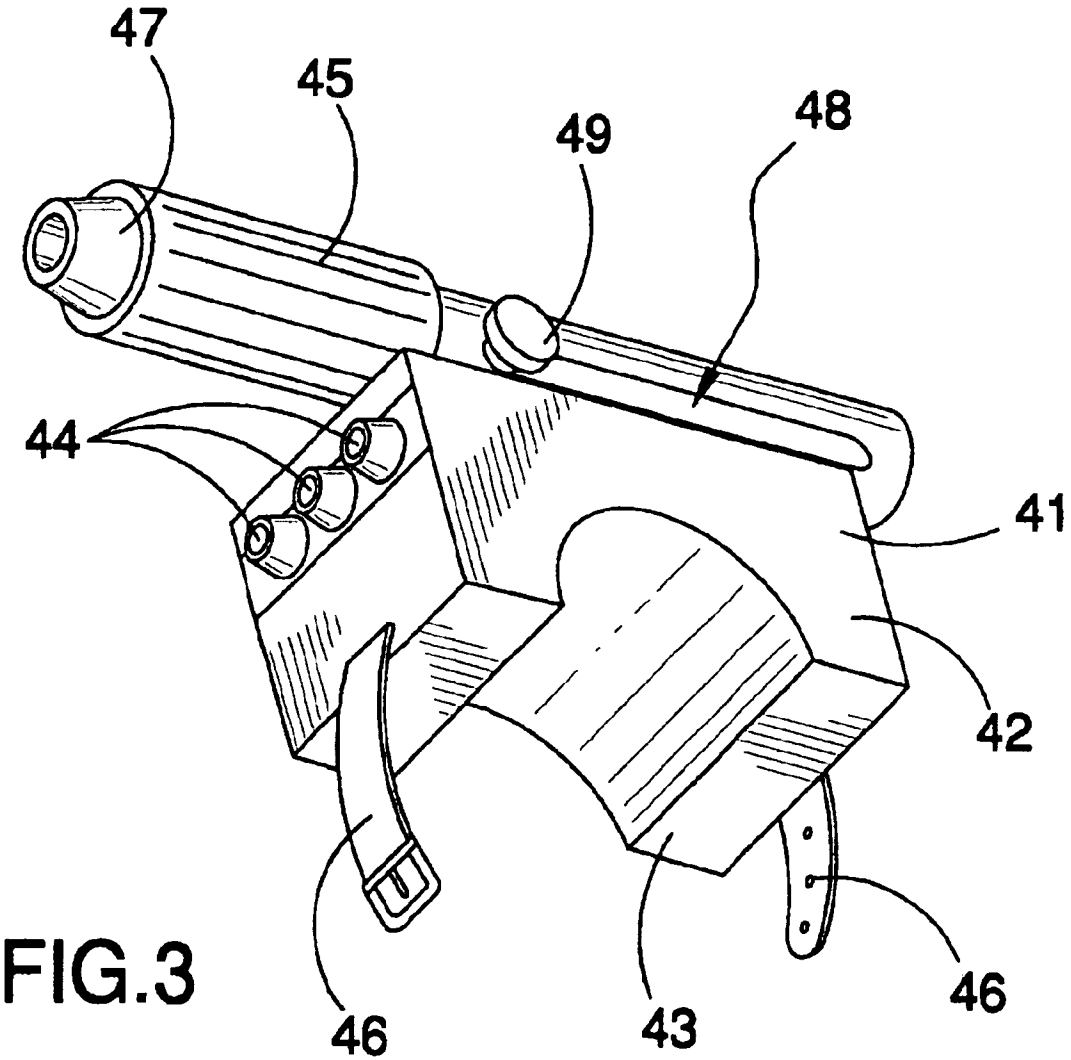
FIG. 3 is a perspective view of a second water gun of the present invention.
Figure 4:
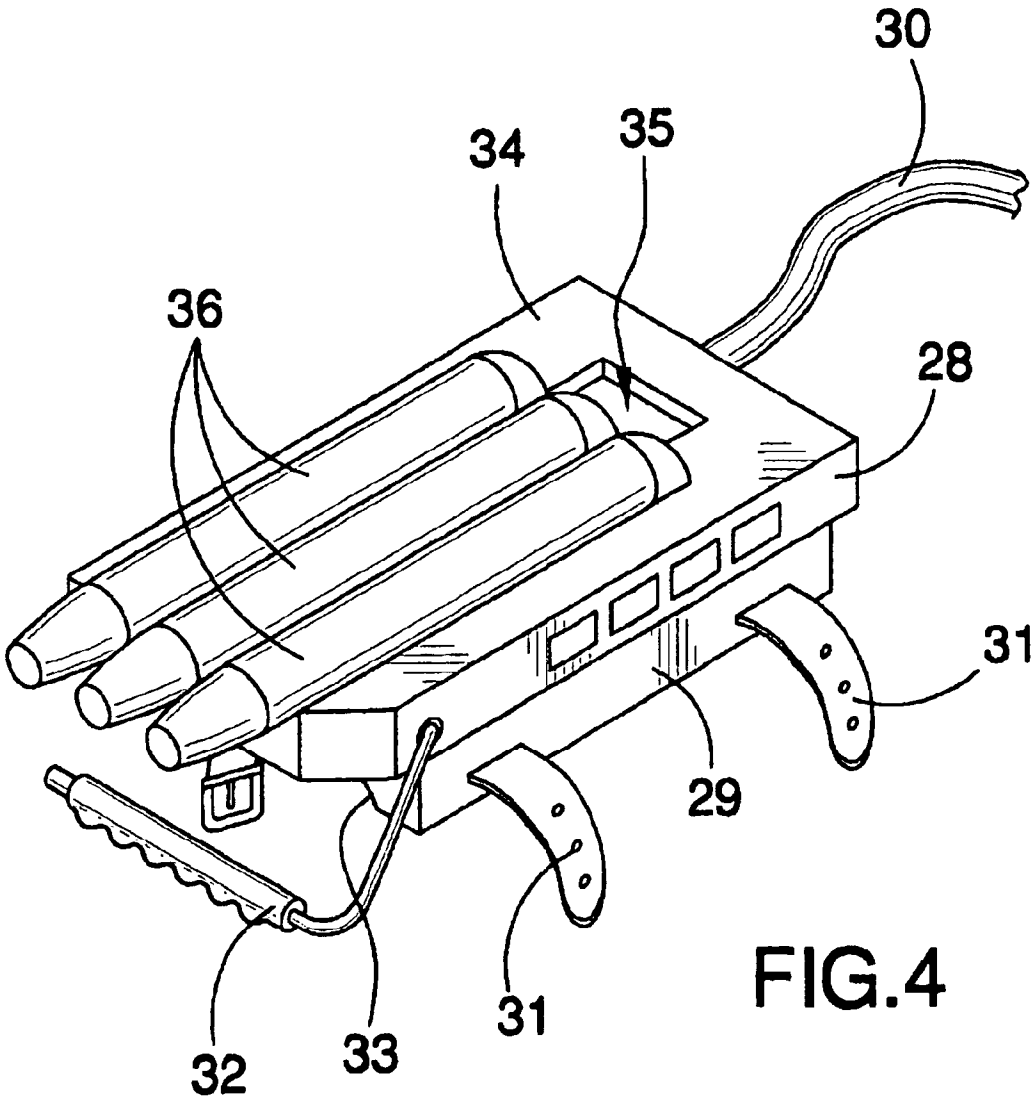
FIG. 4 is a perspective view of a second embodiment of the second water gun of the present invention.

With reference now to the drawings, and in particular to FIGS. 1 through 4 thereof, a new water backpack and gun assembly embodying the principles and concepts of the present invention and generally designated by the reference numeral 10 will be described.

As best illustrated in FIGS. 1 through 4, the water backpack and gun assembly 10 generally comprises a tank 11 being adapted to be carried upon a user's back and being adapted to carry water therein and having a main portion 12 and end portions 14,15, and also having a cap member 16 being removably disposed upon an opening in a top wall 13 of the tank 11 through which water is put into the tank 11. The end portions 14,15 are cylindrical-shaped and have parabolic-shaped top and bottom ends with the main portion 12 being laterally curved to conform to a user's back.

A strap assembly is conventionally attached to the tank 11 for allowing a user to carry the tank 11 upon one's back. The strap assembly includes pairs of straps 17–20 having ends being securely and conventionally attached to a side wall of the main portion 12 of the tank 11, and also includes buckles 21,22 for fastening the straps 17–20 together.

A means of shooting water from the tank 11 including a pump 23 being conventionally disposed in the tank 11 for urging water from the tank 11, and also includes a battery 24 being conventionally connected to the pump 23, and further includes a switch 25 being conventionally connected to the battery 24 and to the pump 23 for the energizing of the pump 23, and also includes water guns 28,41 being conventionally connected with hoses 30,51 to the tank 11, and further includes triggers 32,50 for discharging water from the water guns 28,41. The means of shooting water from the tank 11 further includes rigid pockets 26,27 being securely and conventionally attached to walls of the end portions 14,15 of the tank 11 for supporting and holding the triggers 50. The water guns 28,41 include first water guns 28 each having a first nozzle support member 29 being adapted to fasten to a user's hand/arm and being conventionally connected to one of the hoses 30, and also having tubular spray nozzles 36 being conventionally attached to the first nozzle support member 29, and further having first strap members 31 being conventionally attached to the first nozzle support member 29 for fastening the first water gun 28 to the user's hand/arm, and also having one of the triggers 32 being conventionally attached to the first nozzle support member 29 for releasing water through the tubular spray nozzles 36, and further having a guard member 37 being removably attached to the tubular spray nozzles 36. The first nozzle support member 29 has a beveled bottom wall, side, end, and top walls 33,34 with the top wall 34 having recessed portion 35 upon which the tubular spray nozzles 36 are securely disposed. The first strap members 31 are conventionally attached to the side walls of the first nozzle support member 29. Each of the tubular spray nozzles 36 has a tapered discharge end. The guard member 37 includes a fastener 38 and a pair of opposed plate members 39,40 being conventionally attached to extending outwardly of the fastener 38. The water guns 28,41 further include second water guns 41 each having a second nozzle support member 42, and also having nozzles 44 being conventionally attached to the second nozzle support member 42, and further having a balloon-ejecting cannon member 45 being conventionally mounted to the second nozzle support member 42, and also having second strap members 46 being conventionally attached to the second nozzle support member 42 for fastening the second water gun 41 to the user's hand/arm, and also having one of the triggers 50 being conventionally connected to the second nozzle support member 42 for discharging water through the nozzles 44 and the balloon-ejecting cannon member 45. The second nozzle support member 42 has top, end, and side walls, and also has a beveled bottom wall 53. The balloon-ejecting cannon member 45 includes an elongate tubular member 47 having diametrically-opposed longitudinal slots 48 being disposed through a wall thereof, and also having a launcher member 49 being slidably and conventionally disposed in the elongate tubular member 47 and through the diametrically-opposed slots 48.

In use, the user straps the water guns 28,41 to one's hands and or arms, and pulls on the triggers 32,50 which discharges water from the tank 11 through the tubular spray nozzles 36 and the nozzles 44 and the balloon-ejecting cannon member 45. The user can attach a balloon on an discharge end of the elongate tubular member 47 and can fill the balloon with water from the tank 11, and then use the launcher member 49 to eject the balloon.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the water backpack and gun assembly. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A water backpack and gun assembly comprising:

a tank being adapted to be carried upon a user's back and being adapted to carry water therein and having a main portion and end portions, and also having a cap member being removably disposed upon an opening in a top wall of said tank through which water is put into said tank, said end portions being cylindrical-shaped and having parabolic-shaped top and bottom ends, said main portion being laterally curved to conform to a user's back:

a strap assembly being attached to said tank for allowing a user to carry said tank upon one's back, said strap assembly including pairs of straps having ends being securely attached to a side wall of said main portion of said tank, and also including buckles for fastening said straps together; and a means of shooting water from said tank including a pump being disposed in said tank for urging from said tank, and also including a battery being connected to said pump, and further including a switch being connected to said battery and to said pump for the energizing of said pump, and also including water guns being connected with hoses to said water tank, and further including triggers for discharging water through said water guns, said means of shooting water from said tank further including rigid pockets being securely attached to walls of said end portions of said tank for supporting and holding said triggers, said water guns including first water guns each having a first nozzle support member being adapted to fasten to a user's hand/arm and being connected to one of said hoses, and also having tubular spray nozzles attached to said first nozzle support member, and further having first strap members being attached to said first nozzle support member for fastening said first water gun to the user's hand/arm, and also having one of said triggers being attached to said first nozzle support member for discharging water through said tubular spray nozzles, and further having a guard member being removably attached to said tubular spray nozzles.

2. The water backpack and gun assembly as described in claim 1, wherein said first nozzle support member has a beveled bottom wall, side, end, and top walls with said top wall having recessed portion upon which said tubular spray nozzles are securely disposed.

3. The water backpack and gun assembly as described in claim 2, wherein said first strap members being attached to said side walls of said first nozzle support member.

4. The water backpack and gun assembly as described in claim 3, wherein each of said tubular spray nozzles has a tapered discharge end.

5. The water backpack and gun assembly as described in claim 4, wherein said guard member includes a fastener and a pair of opposed plate members being attached to extending outwardly of said fastener.

6. The water backpack and gun assembly as described in claim 4, wherein said water guns further include second water guns each having a second nozzle support member, and also having nozzles being attached to said second nozzle support member, and further having a balloon-ejecting cannon member being mounted to said second nozzle support member, and also having second strap members being attached to said second nozzle support member for fastening said second water gun to the user's hand/arm, and also having one of said triggers connected to said second nozzle support member for releasing water through said nozzles and said balloon-ejecting cannon member.

7. The water backpack and gun assembly as described in claim 6, wherein said second nozzle support member has top, end, and side walls, and also has a beveled bottom wall.

8. The water backpack and gun assembly as described in claim 7, wherein said balloon-ejecting cannon member includes an elongate tubular member having diametrically-opposed longitudinal slots disposed through a wall thereof, and also having a launcher member slidably disposed in said elongate tubular member and through said diametrically-opposed slots.

* * * * *